US009016528B2

(12) United States Patent
Peirsman et al.

(10) Patent No.: US 9,016,528 B2
(45) Date of Patent: Apr. 28, 2015

(54) BEVERAGE DISPENSING APPARATUS COMPRISING AN INTEGRATED PRESSURE REDUCING CHANNEL

(75) Inventors: Daniel Peirsman, Brussels (BE); Stijn Vandekerckhove, Brussels (BE)

(73) Assignee: AB INBEV NV, Belgium (BE)

( * ) Notice: Subject to any disclaimer, the term of this patent is extended or adjusted under 35 U.S.C. 154(b) by 61 days.

(21) Appl. No.: 13/516,019

(22) PCT Filed: Dec. 16, 2010

(86) PCT No.: PCT/EP2010/069963

§ 371 (c)(1),
(2), (4) Date: Aug. 6, 2012

(87) PCT Pub. No.: WO2011/073343

PCT Pub. Date: Jun. 23, 2011

(65) Prior Publication Data

US 2012/0285998 A1 Nov. 15, 2012

(30) Foreign Application Priority Data

Dec. 18, 2009 (EP) ..... 09015692

(51) Int. Cl.
*B67D 1/12* (2006.01)
*B67D 1/04* (2006.01)

(52) U.S. Cl.
CPC ..... *B67D 1/0412* (2013.01); *B67D 1/1272* (2013.01); *B67D 2210/00052* (2013.01); *B67D 2210/00131* (2013.01)

(58) Field of Classification Search
USPC ..... 222/399, 396; 264/259; 29/527.1
See application file for complete search history.

(56) References Cited

U.S. PATENT DOCUMENTS

| | | | | | |
|---|---|---|---|---|---|
| 2,086,000 | A | * | 7/1937 | Roren | 261/124 |
| 3,065,883 | A | * | 11/1962 | Nelson | 222/323 |
| 3,245,583 | A | * | 4/1966 | Miller et al. | 222/61 |
| 3,272,404 | A | * | 9/1966 | Graves et al. | 222/396 |

(Continued)

FOREIGN PATENT DOCUMENTS

| | | |
|---|---|---|
| AU | 2008240331 | 11/2008 |
| DE | 19802291 | 8/1999 |
| DE | 10211663 | 10/2003 |

(Continued)

OTHER PUBLICATIONS

International Search Report for PCT/EP2010/069963, Completed by the European Patent Office on Jan. 27, 2011, 6 Pages.

*Primary Examiner* — Donnell Long
(74) *Attorney, Agent, or Firm* — Brooks Kushman P.C.

(57) ABSTRACT

A beverage dispensing apparatus is provided. The apparatus includes a container containing a beverage to be dispensed. Pressurizing means are provided for increasing the pressure in the interior of the container. A dispensing duct brings in fluid communication the liquid beverage contained in the container with the exterior environment and draws the beverage out of the container. The dispensing duct comprises a dispensing pipe opening to ambient via a valve, and a pressure reducing channel with an opening connecting in fluid communication the interior of the container with the dispensing pipe. The pressure reducing channel is disposed in a housing made of two half bodies joined together. Each body includes a matching open channel forming the closed pressure reducing channel upon joining. At least one of the half bodies is an integral part of either the container's closure or the chime.

20 Claims, 3 Drawing Sheets

(56) References Cited

U.S. PATENT DOCUMENTS

| | | | | |
|---|---|---|---|---|
| 3,372,838 | A | 3/1968 | Smith et al. | |
| 3,373,907 | A * | 3/1968 | Batrow | 222/399 |
| 3,434,632 | A * | 3/1969 | Batrow | 222/400.5 |
| 3,561,649 | A * | 2/1971 | Wilson | 222/399 |
| 4,978,478 | A | 12/1990 | Vonderau et al. | |
| 5,199,609 | A | 4/1993 | Ash, Jr. | |
| 5,240,144 | A | 8/1993 | Feldman | |
| 5,251,787 | A | 10/1993 | Simson | |
| 5,383,576 | A | 1/1995 | Richter et al. | |
| 5,411,172 | A * | 5/1995 | Brugerolle et al. | 222/4 |
| 5,573,145 | A | 11/1996 | Groh | |
| 5,819,806 | A | 10/1998 | Gasami et al. | |
| 6,403,008 | B1 | 6/2002 | Schann | |
| 6,695,177 | B2 * | 2/2004 | Blicher | 222/396 |
| 7,247,151 | B2 * | 7/2007 | Slawson | 604/197 |
| 7,810,679 | B2 * | 10/2010 | Wauters et al. | 222/399 |
| 2003/0172971 | A1 | 9/2003 | Yoshino et al. | |
| 2007/0272317 | A1 * | 11/2007 | Klopfenstein et al. | 137/889 |
| 2009/0108031 | A1 | 4/2009 | Anderson | |

FOREIGN PATENT DOCUMENTS

| | | |
|---|---|---|
| DE | 102007001215 | 10/2008 |
| EP | 0149352 | 7/1985 |
| EP | 1088640 | 4/2001 |
| FR | 2418352 | 9/1979 |
| GB | 1163761 | 9/1969 |
| GB | 1427732 | 3/1976 |
| JP | 4331879 | 11/1992 |
| JP | 7217755 | 8/1995 |
| JP | 11170296 | 6/1999 |
| WO | 9429094 | 12/1994 |
| WO | 2005007559 | 1/2005 |
| WO | 2006128653 | 12/2006 |
| WO | 2007019852 | 2/2007 |
| WO | 2007019853 | 2/2007 |
| WO | 2007145641 | 12/2007 |

* cited by examiner (a)

(b)

(a)

(b)

BEVERAGE DISPENSING APPARATUS COMPRISING AN INTEGRATED PRESSURE REDUCING CHANNEL

CROSS-REFERENCE TO RELATED APPLICATION

This application is the U.S. national phase of PCT Appln. No. PCT/EP2010/069963, filed on Dec. 16, 2010, which claims priority to EP Patent Application No. 09015692.8, filed on Dec. 18, 2009, the disclosures of which are incorporated in their entirety by reference herein.

FIELD OF THE INVENTION

The present invention relates to the field of dispensing devices for liquids, in particular beverages. It concerns an integrated dispensing channel suitable for reducing the pressure of a liquid dispensed from a pressurized container to the ambient. It also concerns a method for manufacturing said dispensing channel.

BACKGROUND OF THE INVENTION

Liquid dispensing devices have been on the market for ages. Many of them rely on a pressurized gas raising the pressure in the interior of a container containing the liquid to be dispensed, in particular a beverage like beer or other carbonized beverages. The gas is either fed directly into the container containing the liquid like e.g., in U.S. Pat. No. 5,199,609 or between an external, rather stiff container and an inner, flexible vessel (e.g., a bag or a flexible bottle) containing the liquid to be dispensed, like in U.S. Pat. No. 5,240,144 (cf. FIGS. 1(*a*)&(*b*)). Both applications have their pros and cons which are well known to the persons skilled in the art. The present invention applies equally to both types of delivery systems.

The over pressure applied to the container for driving the liquid out thereof is usually of the order of 0.5 to 1.0 bar (above atmospheric). It is clear that the flow of a liquid reaching the dispensing tap at such high pressure could easily become uncontrollable and such sudden pressure drop could lead to the formation of unwanted foam. For this reason, it is often necessary to provide means for substantially reducing the pressure of a liquid being dispensed between the container it is extracted from and the tap, where it contacts atmospheric conditions. Several solutions have been proposed to solve this problem.

The simplest method for inducing pressure losses between the container and the dispensing tap is to provide a long dispensing line, of a length of about 1 to 5 m. This solution is self evident in most pubs, wherein the kegs are stored in a cellar or next room, connected to the tap by a long line. For smaller systems like home dispensers, however, this solution has drawbacks, such as requiring a specific handling for fitting such long line in a dispensing apparatus, usually coiling it. A substantial amount of liquid remains in the line after each dispensing. Said stagnant liquid is the first to flow out of the tap at the next dispense. This of course has the inconvenience that the beverage stored in the dispensing line is not controlled thermally and would result in dispensing e.g., beer at a temperature above the desired serving temperature. A further inconvenient is when changing container, the liquid stored in the line may yield serious hygienic concerns and, in case of a different beverage being mounted on the appliance, to undesired flavours mixing. For solving this latter problem, it has been proposed to change the dispensing line each time the container is being changed (cf. e.g., WO2007/019853, dispensing line 32 in FIGS. 35, 37, and 38).

An alternative to increasing the length of the dispensing line for generating pressure losses in a flowing liquid is to vary the cross-sectional area of the line. For instance, it is proposed in WO2007/019852 to provide dispensing lines comprising at least two sections, a first, upstream section having a cross-sectional area smaller than a second, downstream section. Such line can be manufactured by joining two tubes of different diameter, or by deformation of a polymeric tube, preferably by cold rolling. US2009/0108031 discloses a dispensing line comprising at least three sections of different cross-sectional area forming a venturi tube as illustrated in FIGS. 5 and 9 of said application. The dispensing tube described therein is manufactured by injection moulding two half shells each comprising an open channel with matching geometry to form upon joining thereof a closed channel with the desired venturi geometry. In DE102007001215 a linear tube section at the inlet of a pressure reducing duct transitions smoothly into a tubular spiral with progressively increasing diameter, finishing in an outlet opening.

U.S. Pat. No. 5,573,145 proposes to reduce pressure of an outflowing liquid by inserting in the dispensing line, upstream from the tap, a device for reducing foaming and flowrate of the liquid. Said flow regulating device consists of a mesh rolled up to form a cylinder and acts as a static mixer. A static mixer is actually the solution taught in AU2008/240331 to reduce the pressure of a liquid flowing out of a dispensing apparatus.

WO2005/007559 discloses a dispensing appliance suitable for receiving a keg. Dispensing of the liquid contained in the keg is ensured by a dispensing line having an inlet in fluid contact with the liquid inside the keg, and the outlet being in contact with ambient. The line is further provided with a heat exchanger 70 located between the inlet and outlet. The heat exchanger 70 is in the form of a housing made of two half shells clamped together and comprising a winding path with heat exchange ribs that provokes pressure losses in the flowing liquid. The keg is first mounted into a chill portion 2 of the dispensing appliance. Then the dispensing tube with heat exchanger is positioned with the inlet on to of a keg's opening. The lid 5 of the appliance is then closed on to of the dispensing tube and the system is ready for use.

An effective but rather expensive and hygienically sensitive solution to reducing the pressure of the flowing liquid is to interpose in the dispensing line a pressure controlling valve between the container and the tap.

The solutions to reducing the pressure of a flowing liquid reviewed supra are all relatively expensive as they all require some degree of assembly. The cost of a dispensing line relative to the volume of beverage dispensed therewith may appear insignificant if it can be used several times, or is to be mounted on a fixed dispensing apparatus. Recently, a market for stand-alone home appliances has been developing rapidly. In particular, some of these appliances are not meant to be reloaded after use with a new container and should be disposed of once the original container is empty. It is clear that the design of such all-in-one, ready-to-use, disposable appliances is severely cost driven, as the cost of the packaging and dispensing mechanism should not unreasonably outweigh the cost of the beverage to be dispensed, and sold in relatively small quantities in a container of a capacity of the order of 1 to 10 l, maybe up to 20 l. Furthermore, recycling of the components of disposable appliances is a problem which cannot be overlooked nowadays. A major problem with recycling is separating the appliance components made of differing materials. Another problem is the difficulty in recycling elastomeric materials which could be used in particular in cases wherein a long line needs be coiled.

There therefore remains a need for providing pressure regulating and flow limiting lines in a pressure driven liquid dispensing apparatus which is effective in controlling the pressure and flow rate of a liquid, which can be produced economically, and which is compatible with the economics of recycling.

SUMMARY OF THE INVENTION

The present invention is defined in the appended independent claims. Preferred embodiments are defined in the dependent claims. The present invention provides a beverage dispensing apparatus for dispensing a beverage comprising:

- A container containing a beverage to be dispensed, wherein the container's opening is closed with a closure and the container may be dressed with a chime;
- Pressurizing means for increasing the pressure in the interior of the container;
- A dispensing duct bringing in fluid communication the liquid beverage contained in the container with the exterior, for drawing beverage out of the container, said dispensing duct comprising:
  - A dispensing pipe opening to ambient via a valve (35); and
  - A pressure reducing channel with an opening (6) connecting in fluid communication the interior of the container with the dispensing pipe.

wherein, the pressure reducing channel is disposed in a housing made of two half bodies joint together, each body comprising a matching open channel forming the closed pressure reducing channel upon joining, and in that at least one of the half bodies is an integral part of either the container's closure or the chime, if any.

The chime of a container is defined as "the edge or rim of a cask or drum", in http://www.merriam-webster.com/dictionary/chime. This definition clearly establishes that the chime is an integral part of the container and excludes the lid of a re-loadable dispensing appliance as disclosed e.g., in WO2005/007559. In case of a stand alone, ready to use dispensing appliance, the elements required for ensuring the dispensing of the liquid, such as dispensing tube, pressure cartridge, pressure drop means etc. are generally encased in the chime To effectively reduce the pressure of a flowing liquid, the channel of the present invention preferably comprises one or more curves, advantageously sharp curves, and/or a varying cross-sectional area. The drawing stem, if any, and the dispensing pipe may be produced separately and then joined to the housing of the channel, or either of them can be an integral part of the half bodies forming the housing.

The present invention is particularly advantageous for home appliances, in particular disposable home appliances, where the cost of the dispenser per liter of beverage dispensed is particularly critical. To decrease the cost of manufacturing, the number of assembly steps must be reduced. The present invention also provides a manufacturing technique particularly suited for producing a beverage dispensing apparatus according to the present invention.

The present invention therefore also concerns a method for producing a pressure reducing channel for reducing the pressure of a liquid flowing through a dispensing duct of a pressure driven beverage dispensing apparatus as defined supra, said method comprising the following steps:

- Injection moulding two half bodies of a housing, each half body comprising on their inner surface an open channel matching the open channel of the other half;
- Bringing the two half bodies in abutting relationship, with the open channel of one half body vis-à-vis the open channel of the other half body to thus form a closed channel (5);

joining the two half bodies to yield a fluid tight channel; wherein at least one of the half bodies is an integral part of either the closure of the container containing the beverage to be dispensed or of the chime dressing said container, if any.

The two injection moulded half bodies are preferably joined by gluing, welding, over-injection, or by any mechanical fastening means. In order to ensure a proper alignment of the two half bodies and fluid tightness of the closed channel, it is advantageous to provide the open channel in one of the two half bodies with walls and the open channel of the other half body with corresponding recesses.

DETAILED DESCRIPTION OF THE INVENTION

Pressure Reducing Channel

Figure 1:
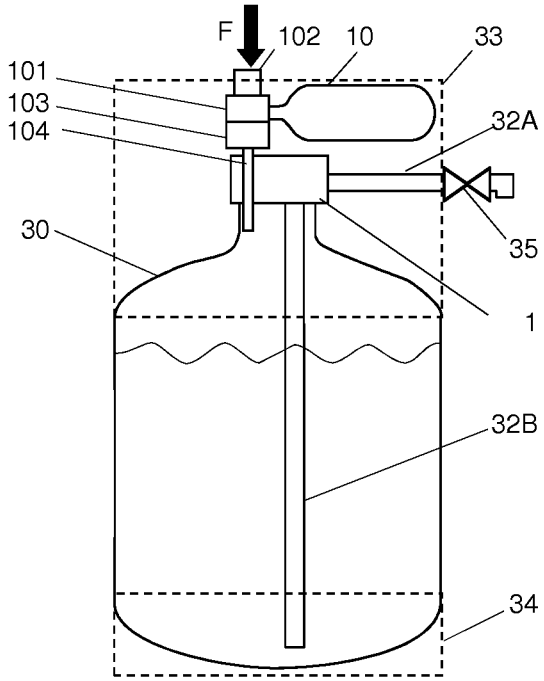
FIG. 1: schematic representation of two embodiments of a dispensing apparatus according to the present invention.
Figure 1:
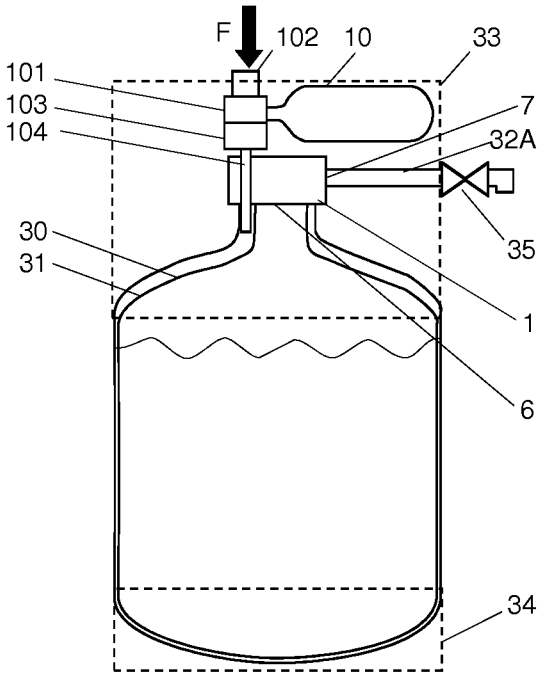

FIG. 1 shows two alternative embodiments of liquid dispensing devices according to the present invention. The design of the devices depicted in FIG. 1 is typical of disposable home dispensing devices, but the invention is not limited to these types of appliances, and can, on the contrary, be applied to any type of beverage dispensing apparatus. In both embodiments of FIG. 1, the dispensing of a liquid, generally a beverage like a beer or a carbonated soft drink, is driven by a pressurized gas contained in a gas cartridge (10). Upon piercing of the closure of the pressurized gas cartridge (10) by actuation by an actuator (102) of a piercing unit (101), the gas contained in the cartridge (10) is brought into fluid communication with the container (30) at a reduced pressure via the pressure regulating valve (103). In FIG. 1(*a*) the gas is introduced through the gas duct (104) directly into the container (30) and brought into contact with the liquid contained therein, whilst in the embodiment depicted in FIG. 1(*b*), the gas is injected at the interface between an outer, rather rigid container (30) and a flexible inner container or bag (31) containing the liquid. In this latter embodiment, the gas never contacts the liquid to be dispensed.

In both embodiments, the pressure in the vessel (30, 31) increases to a level of the order of 0.5 to 1.0 or 2.0 bar above atmospheric and forces the liquid through the channel opening (6), via the drawing stem (32B), if any, and flows along the dispensing tube (32A) to reach the tap (35). In the case of bag-in-containers as illustrated in FIG. 1(*b*), the use of a drawing stem (32B) is not mandatory since the bag (30) collapses upon pressurization of the volume comprised between the bag (30) and the container (31), thus allowing the beverage to contact the channel opening (6) without necessarily requiring a drawing stem (32B). In order to control the pressure and rate of the flowing liquid reaching the open tap at atmospheric pressure, it is proposed to interpose a pressure reducing channel between the container (30) and the tap (35), which is housed in housing (1) as represented in FIG. 1. A top chime (33) generally made of plastic, such as polypropylene, serves for aesthetic as well as safety reasons, to hide and protect from any mishandling or from any impact the dispensing systems and pressurized gas container. A bottom stand (34) generally made of the same material as the top chime (33) gives stability to the dispenser when standing in its upright position.

Figure 2:
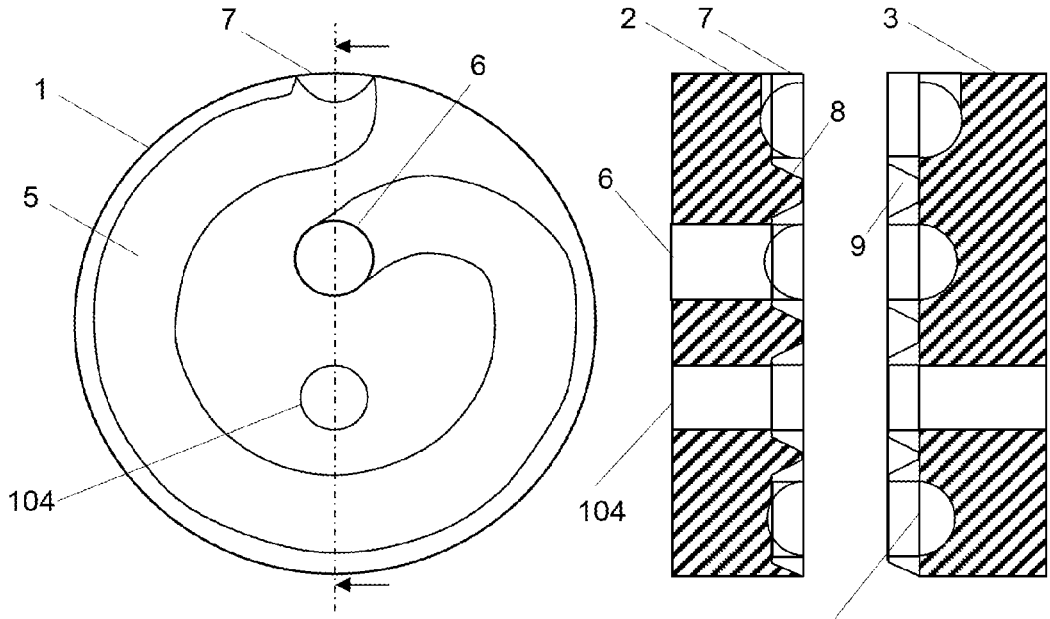
FIG. 2: schematic representation of a first embodiment of a pressure reducing channel according to the present invention.
Figure 3:
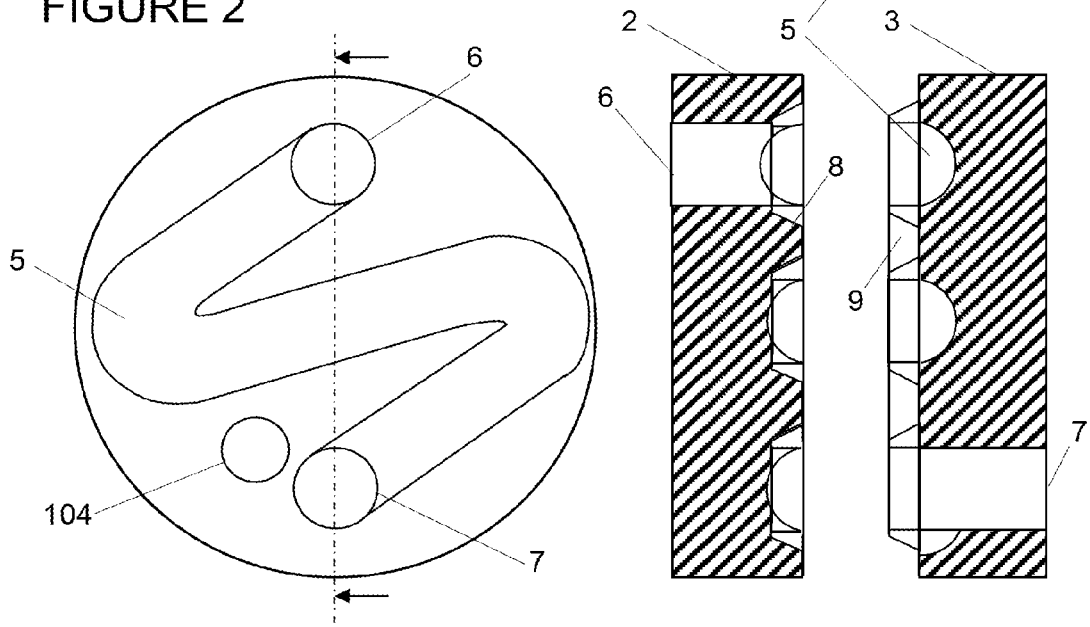
FIG. 3: schematic representation of a second embodiment of a pressure reducing channel according to the present invention.

FIGS. 2 and 3 illustrate two embodiments of a housing (1) comprising a closed channel (5) suitable for reducing to a desirable level the pressure and rate of a liquid flowing from the inlet opening (6) to the outlet opening (7). In the Figures, the housing (1) is represented as constituting the closure of the container (30). Although this embodiment is particularly preferred, the present invention is not restricted thereto. Indeed, it is possible to integrate the channel (5) in a housing forming part of, or even constituting the chime (33), for example in that the external walls of the first and second half bodies (2, 3) define the chime (33). It is also possible that one half body (2) is part of the closure and the other half body (3) is part of the chime. If the housing forms part of the closure of the container, it may be desirable to provide a through-channel (104) fluidly connecting the closure surface facing outside of the container to the surface facing inside the container to allow injection of the propellant gas into the container (30).

The inlet opening (6) brings in fluid communication the pressure reducing channel (5) with the interior of the container, via the drawing stem (32B) if any. For this reason it may be advantageous to locate said inlet opening (6) at the closure surface facing inside the container as represented in FIGS. 2 and 3. The outlet opening (7), on the other hand, may equally well, depending on the desired design, be located at the closure surface facing outside the container (cf. FIG. 3) or at an edge thereof, the outlet section (7) being normal to the inlet section (6) of channel (5) (cf. FIG. 2).

Pressure losses in the flowing beverage can be generated by a sinuous or curved channel. The sinuosity of the channel increases its length and comprises bends; sharp bends increase the level of pressure losses, but also enhance foam generation, therefore careful consideration in the design of the circuit of channel (5) is required to balance these two antagonistic effects. Pressure losses may also be generated by varying the cross-sectional area of the channel (not represented in the Figures) and by providing the surface of the channel with a structure, such as rugosity or a series of grooves normal to the liquid flow (not represented in the Figures).

Manufacturing Method

The housing hosting the pressure reducing channel (5) of the present invention is advantageously manufactured by Injection moulding two half bodies (2, 3), each half body comprising on their inner surface open channels matching the open channels of the other half. The two half bodies are preferably made of a polymer or copolymer of any of polypropylene, polyethylene (oriented or not), polyamide, polyesters like PET, etc. and blends thereof. Polypropylene is preferred as this is the material usually used for the chime (33). The two half bodies (2, 3) are then brought in abutting relationship, with the open channel of one half body vis-à-vis the open channel of the other half body to thus form a closed channel (5). These two steps can be performed using a single tool with two cavities corresponding to each half body and located in two different sections of the tool, filling the cavities by injection moulding a polymer to form the half bodies, moving the two cavities in vis-à-vis by sliding or rotating the tool section comprising one cavity relative to the other section. Once in abutting relation, the two half bodies are to be joined to form a fluid tight channel (5). The joining of the two half bodies can be performed by any means known to the person skilled in the art, such as welding using a solvent, heat, or vibration, gluing, using mechanical fastening, like screws, snap fittings, etc. It is preferred, however, to join the two half bodies by over injection, within the same tool, of a polymer, usually the same as the one used for the half bodies, at the interface between the two half bodies. This solution is highly advantageous as it can be carried out in the same tool without any additional assembly step, and it ensures gas tightness of the closed channel (5). Examples of methods using over injection of a polymer to join two half shells in a single tool are described In e.g., U.S. Pat. No. 5,819,806, JP11170296, JP4331879, JP7217755, DE10211663, EP1088640, which contents are all included herein by reference.

In order to facilitate the alignment of the two half bodies upon joining and to ensure fluid tightness of the thus obtained closed channel (5), the open channel in one of the two half bodies (2, 3) may be provided with walls (8) and the open channel of the other half body (3, 2) with corresponding recesses (9). The recesses may be matching accurately the protruding walls or, on the contrary, leave an opening forming a channel suitable for injecting the joining polymer therein for bonding the two half bodies. The walls (8) and recesses (9) depicted in FIGS. 2 and 3 are of the matching type.

Figure 4:
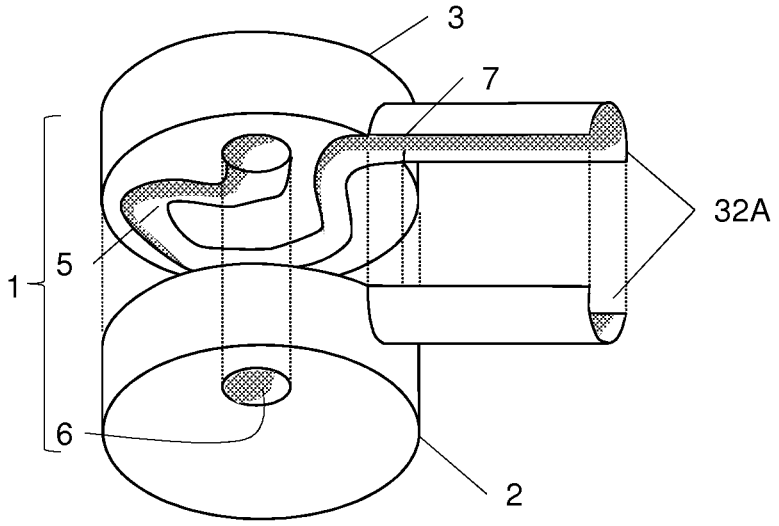
FIG. 4: schematic representation of two embodiments of a housing comprising a pressure reducing channel with integrated dispensing duct.
Figure 4:
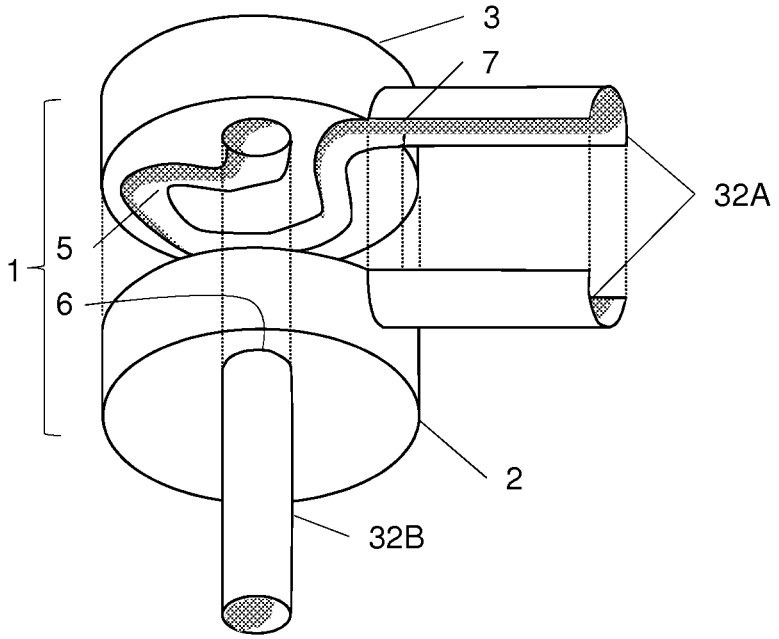

The drawing stem (32B), if any, and the dispensing pipe (32A) may be assembled to the inlet (6) and outlet (7) of the channel (5), respectively, by any means known in the art. Preferably, however, they can be an integral part of the housing (1) as illustrated in FIGS. 4(*a*)&(*b*). If one of the half bodies (2, 3) is an integral part of the chime (33), the dispensing duct (32A) could then be integrated in the chime too.

Advantages

A pressure reducing channel according to the present invention is particularly advantageous for dispensing apparatuses of relatively small size, corresponding for example to home appliances. It is particularly suitable for disposable home dispensing apparatuses, since in such devices the pressure reducing channel needs not be replaced or cleaned after use. For dispensing apparatuses which can be reloaded with a fresh container after use, the housing (1) is advantageously part of the container's closure, so that a new, sterilized channel is supplied with each new container. For disposable dispensing apparatuses, the housing (1) may equally advantageously be part of the container's closure or the chime, since the whole appliance is disposed of after use. In any case, the hygiene of the dispensing duct (32A&B, 5) is ensured by an industrial sterilization stage in plant, which eliminates any contamination risks associated with changing a container without changing the dispensing duct.

The pressure reducing channel according to the present invention can be produced at large volumes and low cost with the claimed method, since it can be fully manufactured and integrated in either the closure or the chime within the same tool, without any separate assembling step.

Recycling of the dispenser after use is also facilitated as all the polymeric components comprised within the chime (33), such as the piercing system (101), actuator (102), pressure regulating valve (103), channel housing (1), and gas and dispensing ducts (104, 32A, 32B) can be made of the same material as the chime itself, for example polypropylene (PP). After use, the whole PP chime (33) and stand (34) can be ripped off the container, generally made of PET, and ground for recycling. The metal parts within the chime (33), such as the cartridge (10) and piercing member of the piercing system, can easily be separated from the polymeric parts by techniques well known in the art, e.g., with a magnet or by gravimetric separation. The absence of elastomeric components as would be required with a flexible hose, is also advantageous for recycling.

The invention claimed is:

1. A beverage dispensing apparatus for dispensing a beverage comprising:

a container containing a beverage to be dispensed, wherein the container's opening is closed with a closure and the container includes a chime;

pressurizing means for increasing the pressure in the interior of the container; and a dispensing duct bringing in fluid communication the liquid beverage contained in the container with the exterior, for drawing beverage out of the container, said dispensing duct comprising:

a dispensing pipe opening to ambient via a valve; and a pressure reducing channel with an opening connecting in fluid communication the interior of the container with the dispensing pipe;

wherein, the pressure reducing channel is disposed in a housing made of two half bodies joined together, each body comprising a matching open channel forming the closed pressure reducing channel upon joining, and wherein at least one of the half bodies is an integral part of the chime, and wherein the housing comprises also a through channel fluidly connecting the external surface of the first half body with the external surface of the second half body, for the injection of propellant gas into the container.

2. The dispensing apparatus according to claim 1, wherein the pressure reducing channel is curved and/or has a varying cross-sectional area.

3. The dispensing apparatus according to claim 1, wherein the two half bodies are injection moulded and joined by gluing, welding, over-injection, or by any mechanical fastening means.

4. The dispensing apparatus according to claim 1, wherein the open channel in one of the two half bodies is provided with walls and the open channel of the other half body is provided with corresponding recesses to ensure alignment of the two half bodies upon joining and to ensure fluid tightness of the closed channel.

5. The dispensing apparatus according to claim 1, wherein components of the dispensing pipe are integral parts of the half bodies.

6. The dispensing apparatus according to claim 1, which is a disposable home beer dispenser.

7. The dispensing apparatus according to claim 1, wherein the housing comprising the channel is made of polypropylene.

8. The dispensing apparatus according to claim 1, wherein the channel comprises at least one sharp bend.

9. A method for producing a pressure reducing channel for reducing the pressure of a liquid flowing through a dispensing duct of a pressure driven beverage dispensing apparatus according to claim 1, said method comprising the following steps:

injection moulding two half bodies of a housing, each half body comprising on their inner surface an open channel matching the open channel of the other half;

bringing the two half bodies in abutting relationship, with the open channel of one half body vis-à-vis the open channel of the other half body to thus form a closed channel; and joining the two half bodies to yield a fluid tight channel;

wherein at least one of the half bodies is an integral part of a chime of a container containing the beverage to be dispensed.

10. The method according to claim 9, wherein the joining of the two half bodies is achieved by over-injection of a polymer at the interface between the two parts, the over-injection being performed within the same tool as for the injection of the half bodies.

11. A beverage dispensing apparatus for dispensing a beverage comprising:

a container containing a beverage to be dispensed, the container having an opening that is closed with a closure;

pressurizing means for increasing the pressure in the interior of the container;

a dispensing duct bringing in fluid communication the liquid beverage contained in the container with the exterior, for drawing beverage out of the container, said dispensing duct comprising:

a dispensing pipe opening to ambient via a valve, and a pressure reducing channel with an opening connecting in fluid communication the interior of the container with the dispensing pipe;

wherein the pressure reducing channel is disposed in a housing made of two half bodies joined together, each body comprising a matching open channel forming the closed pressure reducing channel upon joining, and wherein at least one of the half bodies is an integral part of the closure, and wherein the housing comprises a through channel fluidly connecting the external surface of the first half body with the external surface of the second half body for the injection of propellant gas into the container.

12. A method for producing a pressure reducing channel for reducing the pressure of a liquid flowing through a dispensing duct of a pressure driven beverage dispensing apparatus according to claim 11, said method comprising the following steps:

injection moulding two half bodies of a housing, each half body comprising on their inner surface an open channel matching the open channel of the other half;

bringing the two half bodies in abutting relationship, with the open channel of one half body vis-à-vis the open channel of the other half body to thus form a closed channel; and joining the two half bodies to yield a fluid tight channel;

wherein at least one of the half bodies is an integral part of a closure of a container containing the beverage to be dispensed, and wherein the housing comprises a through channel fluidly connecting the external surface of the first half body with the external surface of the second half body, for the injection of propellant gas into the container.

13. The method according to claim 12, wherein the joining of the two half bodies is achieved by over-injection of a polymer at the interface between the two parts, the over-injection being performed within the same tool as for the injection of the half bodies.

14. The method according to claim 13, wherein the over-injected polymer is the same as the polymer constituting the half bodies.

15. The dispensing apparatus according to claim 11, wherein the pressure reducing channel is curved and/or has a varying cross-sectional area.

16. The dispensing apparatus according to claim 11, wherein the open channel in one of the two half bodies is provided with walls and the open channel of the other half body is provided with corresponding recesses to ensure alignment of the two half bodies upon joining and to ensure fluid tightness of the closed channel.

17. The dispensing apparatus according to claim 11, wherein components of the dispensing pipe are integral parts of the half bodies.

18. The dispensing apparatus according to claim 11, which is a disposable home beer dispenser.

19. The dispensing apparatus according to claim 11, wherein the housing comprising the channel is made of polypropylene.

20. The dispensing apparatus according to claim 11, wherein the channel comprises at least one sharp bend.

* * * * *